US008639144B2

(12) United States Patent
Otsuka

(10) Patent No.: US 8,639,144 B2
(45) Date of Patent: Jan. 28, 2014

(54) FIXING APPARATUS AND IMAGE FORMING APPARATUS IN WHICH TEMPERATURE OF HEATING ROTATING MEMBER IS DETECTED IN NON-CONTACT MANNER

(75) Inventor: Yutaka Otsuka, Toyokawa (JP)

(73) Assignee: Konica Minolta Business Technologies, Inc, Chiyoda-Ku, Tokyo (JP)

( * ) Notice: Subject to any disclaimer, the term of this patent is extended or adjusted under 35 U.S.C. 154(b) by 175 days.

(21) Appl. No.: 13/247,516

(22) Filed: Sep. 28, 2011

(65) Prior Publication Data

US 2012/0082474 A1 Apr. 5, 2012

(30) Foreign Application Priority Data

Oct. 1, 2010 (JP) ..... 2010-223724

(51) Int. Cl.
*G03G 15/20* (2006.01)

(52) U.S. Cl.
USPC ..... 399/69

(58) Field of Classification Search
USPC ..... 399/69, 336, 320, 307, 309
See application file for complete search history.

(56) References Cited

U.S. PATENT DOCUMENTS

| | | | | |
|---|---|---|---|---|
| 7,266,335 | B2 * | 9/2007 | Van Den Berg et al. | 399/309 |
| 7,414,640 | B2 * | 8/2008 | Furuyama | 399/69 |
| 7,787,790 | B2 * | 8/2010 | Tsueda et al. | 399/69 |
| 7,881,625 | B2 * | 2/2011 | Kinouchi et al. | 399/69 |
| 2006/0062585 | A1 * | 3/2006 | Sone et al. | 399/69 |
| 2006/0233565 | A1 * | 10/2006 | Tamaoki | |
| 2007/0280713 | A1 | 12/2007 | Tsueda et al. | |
| 2008/0240748 | A1 | 10/2008 | Kinouchi et al. | |
| 2010/0309950 | A1 * | 12/2010 | Otsuka | 399/69 |

FOREIGN PATENT DOCUMENTS

| | | | |
|---|---|---|---|
| JP | 2-081075 | A | 3/1990 |
| JP | 5-149790 | A | 6/1993 |
| JP | 7-077891 | A | 3/1995 |
| JP | 2002-116655 | A | 4/2002 |
| JP | 2005-345640 | A | 12/2005 |
| JP | 2006-047410 | A | 2/2006 |
| JP | 2006-184071 | A | 7/2006 |
| JP | 2006-301012 | A | 11/2006 |

(Continued)

OTHER PUBLICATIONS

Japanese Office Action (Notice of Grounds of Rejection) dated Nov. 6, 2012, issued in corresponding Japanese Patent Application No. 2010-223724, and English language translation of Office Action. (7 pages).

(Continued)

*Primary Examiner* — Susan Lee
(74) *Attorney, Agent, or Firm* — Buchanan Ingersoll & Rooney PC

(57) ABSTRACT

In a fixing apparatus, a first detection portion detects a temperature of an atmosphere (a first detected temperature) attained by heat conduction from a heating rotating member for fixing a toner image on a sheet of paper by heating, at a position above the heating rotating member. A second detection portion detects a quantity of infrared rays radiated from the heating rotating member, to thereby detect a temperature at a position below the heating rotating member. A heating portion heats the heating rotating member. A control portion controls heating by the heating portion based on a second detected temperature corresponding to the quantity of infrared rays and the first detected temperature.

16 Claims, 6 Drawing Sheets

(56) References Cited

FOREIGN PATENT DOCUMENTS

| | | | |
|---|---|---|---|
| JP | 2007-323060 | A | 12/2007 |
| JP | 2008-257247 | A | 10/2008 |
| JP | 2009-098361 | A | 5/2009 |
| JP | 2009-180974 | A | 8/2009 |
| JP | 2009-229629 | A | 10/2009 |

OTHER PUBLICATIONS

Extended European Search Report dated Jan. 27, 2012, issued by the European Patent Office in the corresponding European Application No. 11183483.4. (5 pages).

* cited by examiner

FIXING APPARATUS AND IMAGE FORMING APPARATUS IN WHICH TEMPERATURE OF HEATING ROTATING MEMBER IS DETECTED IN NON-CONTACT MANNER

This application is based on Japanese Patent Application No. 2010-223724 filed with the Japan Patent Office on Oct. 1, 2010, the entire content of which is hereby incorporated by reference.

BACKGROUND OF THE INVENTION

1. Field of the Invention

The present invention relates to a fixing apparatus and an image forming apparatus, and particularly to a fixing apparatus and an image forming apparatus including a temperature detection apparatus detecting a temperature of a heating rotating member in a non-contact manner.

2. Description of the Related Art

A contact type temperature detection apparatus and a non-contact type temperature detection apparatus have conventionally been available as a temperature detection apparatus included in a fixing apparatus. In a contact type temperature detection apparatus, a surface of a fixing member is worn by the temperature detection apparatus in particular in a case where a portion to be detected is located on a heating rotating member such as the fixing member, and image noise results. On the other hand, in a non-contact type temperature detection apparatus, image noise caused by contact is not produced, however, it is characterized by temperature detection accuracy poorer than the contact type.

For example, an infrared sensor or a non-contact thermistor is employed as a non-contact type temperature detection apparatus. An infrared sensor detects infrared rays from a portion to be detected and hence it is excellent in responsiveness. In addition, the infrared sensor is excellent in temperature stability against variation in distance at which it is installed. On the other hand, as the number of pages processed in the fixing apparatus increases, a detection surface is contaminated. As the detection surface is contaminated, responsiveness to variation in temperature at the portion to be detected may become poor or a temperature of the portion to be detected cannot accurately be measured, because a temperature is measured based on a quantity of infrared rays received at the contaminated portion.

Various techniques relating to a conventional fixing apparatus including a non-contact type temperature detection apparatus and a contact type temperature detection apparatus are disclosed.

For example, Document 1 (Japanese Laid-Open Patent Publication No. 05-149790) and Document 2 (Japanese Laid-Open Patent Publication No. 2006-047410) disclose a technique for detecting a temperature of a heating rotating member with both of a non-contact type temperature detection apparatus and a contact type temperature detection apparatus while the heating rotating member remains stopped, finding a detection error therebetween, and correcting a temperature detected by the non-contact type temperature detection apparatus during a rotation period of the heating rotating member based on the error.

In addition, as a technique relating to temperature detection in a fixing apparatus, Document 3 (Japanese Laid-Open Patent Publication No. 2006-184071) discloses a technique for employing a thermistor that has conventionally been used as a contact type temperature detection apparatus as a non-contact type temperature detection apparatus, together with a thermopile representing one example of a non-contact type temperature detection apparatus, and correcting a temperature detected by the thermopile with the temperature detected by the thermistor.

According to the inventions disclosed in Document 1 and Document 2, however, relation between a temperature detected by the non-contact type temperature detection apparatus and a temperature detected by the contact type temperature detection apparatus is not necessarily constant during a period in which the heating rotating member remains stopped and during a period in which the heating rotating member is rotating, and such a situation that unignorable difference between the detected temperature and an actual temperature of the heating rotating member is caused is expected. In addition, according to the invention disclosed in Document 3, if the thermopile is contaminated, such a situation that a temperature of the heating rotating member cannot accurately be detected is expected.

In a case where a temperature of the heating rotating member cannot accurately be detected in the fixing apparatus, a control temperature should be set to a slightly high temperature in order to ensure strength of fixation by the heating rotating member, which leads to increase in power consumption in the fixing apparatus.

SUMMARY OF THE INVENTION

The present invention was made in view of such circumstances. An object of the present invention is to more accurately detect a temperature of a heating rotating member in a fixing apparatus and an image forming apparatus.

A fixing apparatus according to the present invention includes a heating rotating member for fixing a toner image on a sheet of paper by heating, a first detection portion for detecting a temperature of an atmosphere attained by heat conduction from the heating rotating member as a first detected temperature, a second detection portion for detecting a quantity of infrared rays radiated from the heating rotating member, a heating portion for heating the heating rotating member, and a control portion for controlling heating by the heating portion based on the first detected temperature from the first detection portion and a second detected temperature corresponding to the quantity of infrared rays from the second detection portion, the first detection portion detects a temperature at a position above the heating rotating member, and the second detection portion detects a temperature at a position below the heating rotating member.

An image forming apparatus according to another aspect of the present invention includes an image forming portion for forming a toner image on a sheet of paper and the fixing apparatus described above.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

1. Overall Structure of Printer

Figure 1:
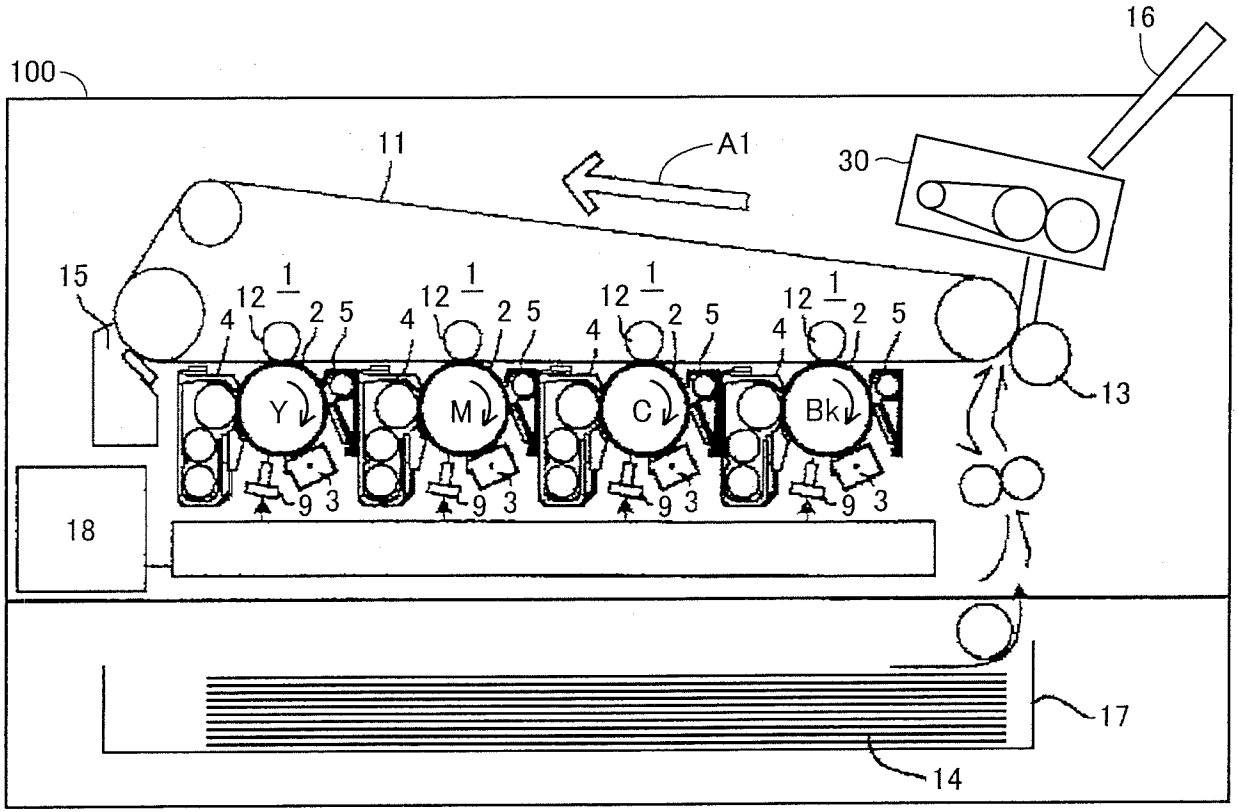
FIG. 1 is a diagram schematically showing an internal structure of a printer representing one embodiment of a fixing apparatus and an image forming apparatus according to the present invention.

FIG. 1 is a diagram schematically showing an internal structure of a tandem type digital color printer (hereinafter referred to as a printer) 100 representing one embodiment of a fixing apparatus and an image forming apparatus according to the present invention.

Referring to FIG. 1, printer 100 is provided with an image forming unit 1 for each color for forming a toner image of each of black (Bk), yellow (Y), magenta (M), and cyan (C). In addition, in printer 100, image forming units 1 are arranged in the order of Y→M→C→Bk from upstream, along an intermediate transfer belt 11 circulating in a direction shown with an arrow A1.

A toner image developed on a photoconductor drum 2 of image forming unit 1 is transferred onto intermediate transfer belt 11 by a primary transfer portion 12 which will be described later at a position of contact with intermediate transfer belt 11.

As the toner image transferred onto intermediate transfer belt 11 passes each image forming unit 1, each color is superimposed on the preceding color and a full-color toner image is finally formed on intermediate transfer belt 11.

Thereafter, in further downstream, the toner image is collectively transferred to a recording sheet 14 such as paper by what is called a secondary transfer portion 13.

Then, recording sheet 14 is sent to a fixing apparatus 30 arranged in an upper portion of printer 100 as a result of rotation of a not-shown transport roller. As recording sheet 14 passes fixing apparatus 30, the toner image is fixed to recording sheet 14. Recording sheet 14 that has passed fixing apparatus 30 is ejected on a paper ejection tray 16.

Recording sheet 14 is stored in a recording sheet cassette 17 arranged in a lowermost portion of printer 100. From that portion, recording sheet 14 is transported to secondary transfer portion 13 one by one.

The toner that has remained on intermediate transfer belt 11 after secondary transfer is removed from intermediate transfer belt 11 by a cleaning blade 15, transported by a not-shown transport screw, and recovered in a not-shown waste toner container.

A control device 18 includes a CPU 501 which will be described later and controls entire printer 100.

A signal in accordance with an image to be formed is transmitted from control device 18 to an exposure control device 19.

Exposure control device 19 drives each exposure portion 9 in accordance with an image to be formed in each color.

Image forming unit 1 is provided with a charging portion 3 for uniformly charging photoconductor drum 2, exposure portion 9 for exposing charged photoconductor drum 2 to light in accordance with an image to be formed, and a development portion 4 for developing an electrostatic latent image formed by exposure with toner of each color.

The toner image developed on photoconductor drum 2 is primarily transferred onto intermediate transfer belt 11 by primary transfer portion 12.

The toner that has remained on photoconductor drum 2 after primary transfer is removed by a cleaning portion 5 arranged downstream of primary transfer portion 12 in a direction of rotation of photoconductor drum 2 and recovered from below of cleaning portion 5.

2. Hardware Configuration of Printer

Figure 2:
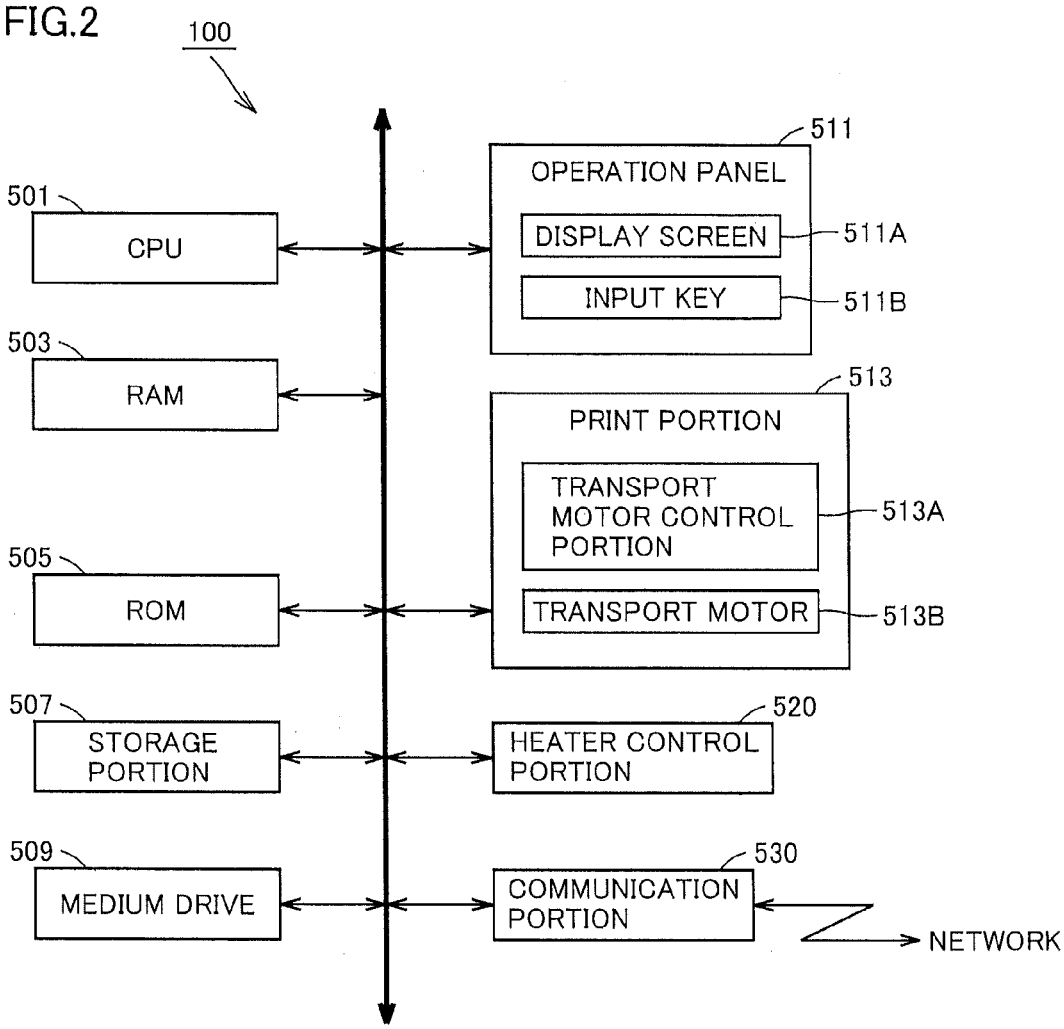
FIG. 2 is a diagram showing a hardware configuration of the printer in FIG. 1.

FIG. 2 is a diagram showing a hardware configuration of printer 100 in FIG. 1.

Referring to FIG. 2, printer 100 includes CPU 501 for overall control of printer 100, a RAM (Random Access memory) 503 for temporarily storing data, a ROM (Read Only Memory) 505 for storing a program, a constant and the like, a storage portion 507 for storing image data and the like, a medium driver 509 for reading and writing data from and to a recording medium (such as a memory card) removably attached to printer 100, an operation panel 511 for accepting a user's operation, a print portion 513 for printing image data on a recording sheet (recording paper), a heater control portion 520 for controlling drive of a heater provided in fixing apparatus 30, and a communication portion 530 for communicating with another device through a network.

Operation panel 511 includes a display screen 511A for displaying a status of printer 100 or choice of a command to the user and an input key 511B.

Print portion 513 includes a transport motor 513B for rotating a transport roller for transporting recording sheet 14 to fixing apparatus 30 and a transport motor control portion 513A for controlling rotation of transport motor 513B.

3. Block Configuration of Main Portion of Printer

Figure 3:
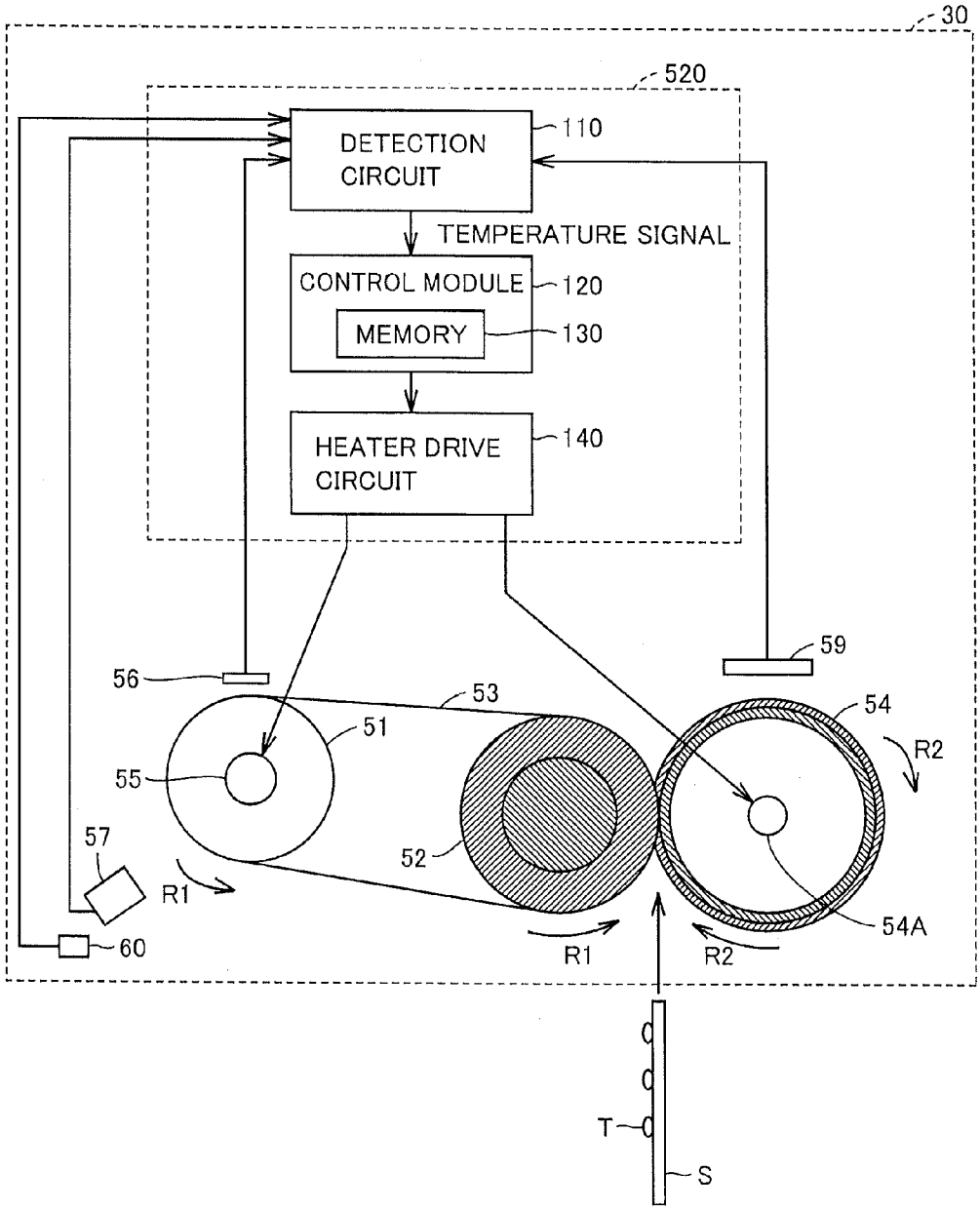
FIG. 3 is a diagram schematically showing an overall configuration of the fixing apparatus in FIG. 1.

FIG. 3 schematically shows an overall configuration of fixing apparatus 30.

Referring to FIG. 3, in fixing apparatus 30, a fixing belt 53 and a pressurization roller 54 sandwich recording sheet 14 sent from below. Then, as both rollers rotate, recording sheet 14 is sent upward. In fixing apparatus 30, a portion where fixing belt 53 and pressurization roller 54 abut to each other forms a nipping portion sandwiching recording sheet 14.

Fixing apparatus 30 is provided with a heating roller 51 and a pressurization roller 52 around which fixing belt 53 is wound. Heating roller 51 contains a heater 55. An arrow R1 shows a direction of rotation of fixing belt 53, and an arrow R2 shows a direction of rotation of pressurization roller 54.

Referring back to FIG. 3, in fixing apparatus 30, a sheet of paper S on which a toner image T is formed is transported to the nipping portion described above such that a surface having toner image T formed is located on the fixing belt 53 side.

Pressurization roller 54 contains a heater 54A.

A thermistor 56 for detecting a surface temperature of fixing belt 53 is arranged above heating roller 51, on an outer side of fixing belt 53. Thermistor 56 detects a surface temperature of fixing belt 53 in a non-contact manner. It is noted that a surface temperature of fixing belt 53 corresponds to a temperature of an atmosphere attained by heat conduction from heating roller 51 representing one example of a heating rotating member.

In addition, a thermopile 57 is arranged below heating roller 51, on an outer side of fixing belt 53. Thermopile 57 detects a surface temperature of fixing belt 53 by detecting a quantity of infrared rays emitted from the surface of fixing belt 53. Namely, thermopile 57 detects a quantity of infrared rays radiated from heating roller 51 representing an example of a heating rotating member.

Moreover, a thermistor 59 for detecting a surface temperature of pressurization roller 54 is arranged above pressurization roller 54, so as not to be in contact with pressurization roller 54.

Further, in the vicinity of heating roller 51 and thermopile 57, a humidity sensor 60 for detecting humidity in a housing accommodating components of fixing apparatus 30 such as heating roller 51 is arranged.

FIG. 3 further shows a block configuration of heater control portion 520 in connection with temperature control in fixing apparatus 30. Heater control portion 520 includes a detection circuit 110, a control module 120, and a heater drive circuit 140. Control module 120 includes a memory 130 representing one example of a storage device. Detection outputs from thermopile 57, thermistors 56 and 59, and humidity sensor 60 are input to detection circuit 110.

Detection circuit 110 transmits a signal indicating a temperature detected by thermopile 57 and thermistors 56 and 59 to control module 120.

Control module 120 is implemented, for example, by CPU 501 executing a program recorded in storage portion 507 or the like as appropriate. Memory 130 stores a program to be executed by CPU 501, data necessary for executing the program, and the like. A detailed configuration of control module 120 will be described later with reference to FIG. 4.

Heater drive circuit 140 supplies drive electric power to heaters 55 and 54A. Control module 120 controls a manner of drive of these heaters by heater drive circuit 140. It is noted that such drive control is basically carried out in a well-known manner such as proportional control based on a predetermined setting temperature or PID (Proportional Integral Differential) control. Specifically, based on such control, a ratio of a time period (duty) during which electric power is fed to each heater at a certain time interval is controlled.

Figure 4:
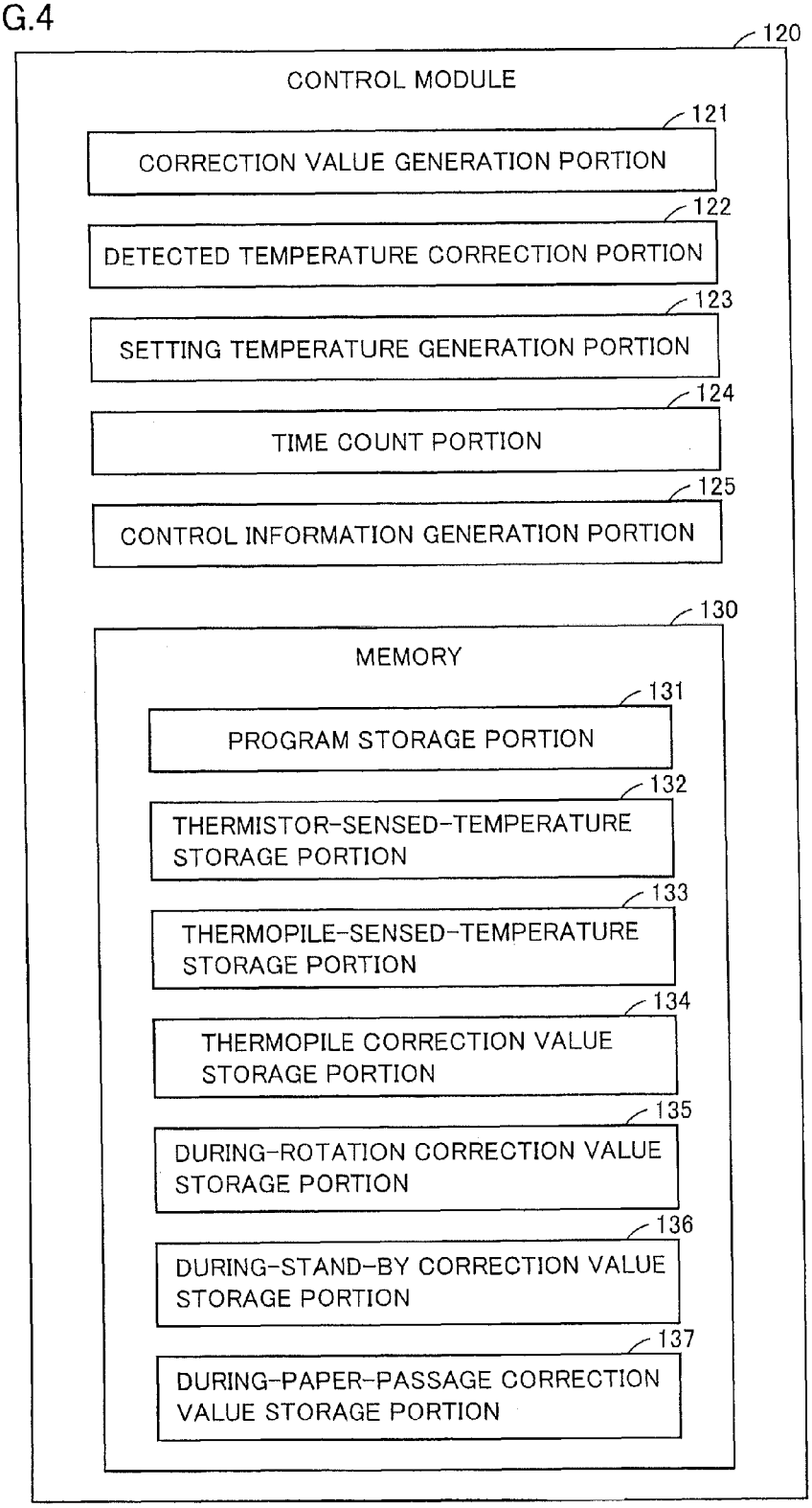
FIG. 4 is a diagram showing a detailed configuration of a control module in FIG. 3.

FIG. 4 is a diagram showing a detailed configuration of control module 120.

Control module 120 includes a correction value generation portion 121 for generating a correction value for a temperature detected by thermistor 56 and/or a temperature detected by thermopile 57, a detected temperature correction portion 122 for correcting these detected temperatures, a setting temperature generation portion 123 for generating the setting temperature described above, a time count portion 124, and a control information generation portion 125 for generating control information for heater drive circuit 140 and transport motor control portion 513A (see FIG. 2).

Memory 130 includes a program storage portion 131 for storing a program to be executed by CPU 501, a thermistor-detected temperature storage portion 132 for storing a temperature detected by thermistor 56, 59, a thermopile-detected temperature storage portion 133 for storing a temperature detected by thermopile 57, a thermopile correction value storage portion 134 for storing a correction value for a temperature detected by thermopile 57, and a during-rotation correction value storage portion 135, a during-stand-by correction value storage portion 136 and a during-paper-passage correction value storage portion 137 each for storing a correction value for a temperature detected by thermistor 56. As will be described later, a correction value for a temperature detected by thermistor 56 is generated during rotation, stand-by, and paper passage of fixing belt 53 (heating roller 51). A correction value during rotation is stored in during-rotation correction value storage portion 135, a correction value during stand-by is stored in during-stand-by correction value storage portion 136, and a correction value during paper passage is stored in during-paper-passage correction value storage portion 137.

4. Specific Example of Fixing Apparatus

An example of a specific structure of fixing apparatus 30 will be shown.

Heating roller 51 has an outer diameter of 25 mm, it is formed such that a hollow aluminum core having a thickness of 0.6 mm is coated with 15 μm-thick PTFE (polytetrafluoroethylene), and it has a dimension of approximately 330 mm in a longitudinal direction of the nipping portion.

Pressurization roller 52 has an outer diameter of 30 mm, and it is formed such that a 4 mm-thick rubber layer and a 2 mm-thick sponge layer are successively formed on a solid iron core having a diameter of 18 mm.

Fixing belt 53 has an outer diameter of 60 mm when it is rolled out into a circle, and a 200 μm-thick rubber layer and a 30 μm-thick PFA (tetrafluoroethylene perfluoro(alkyl vinyl ether) copolymer) layer are formed on a 45 μm-thick nickel base material.

Pressurization roller 54 has an outer diameter of 35 mm, and a 2.5 mm-thick rubber layer and a 30 μm-thick PFA layer are successively formed on a 2.5 mm-thick hollow iron core.

Heater 55 is a 999 W halogen lamp heater and it has a light emission length of 290 mm.

Thermistor 56 is arranged at a central position of a surface of fixing belt 53 in a longitudinal direction of the nipping portion thereof, at a distance by 2 mm therefrom (in a non-contact manner).

Thermistor 59 is arranged in a non-contact manner, at a position distant by 40 mm in the longitudinal direction of the nipping portion from a central position of pressurization roller 54 in that longitudinal direction and at a position distant by 2 mm from the surface of pressurization roller 54.

5. Configuration of Thermistor

Figure 5:
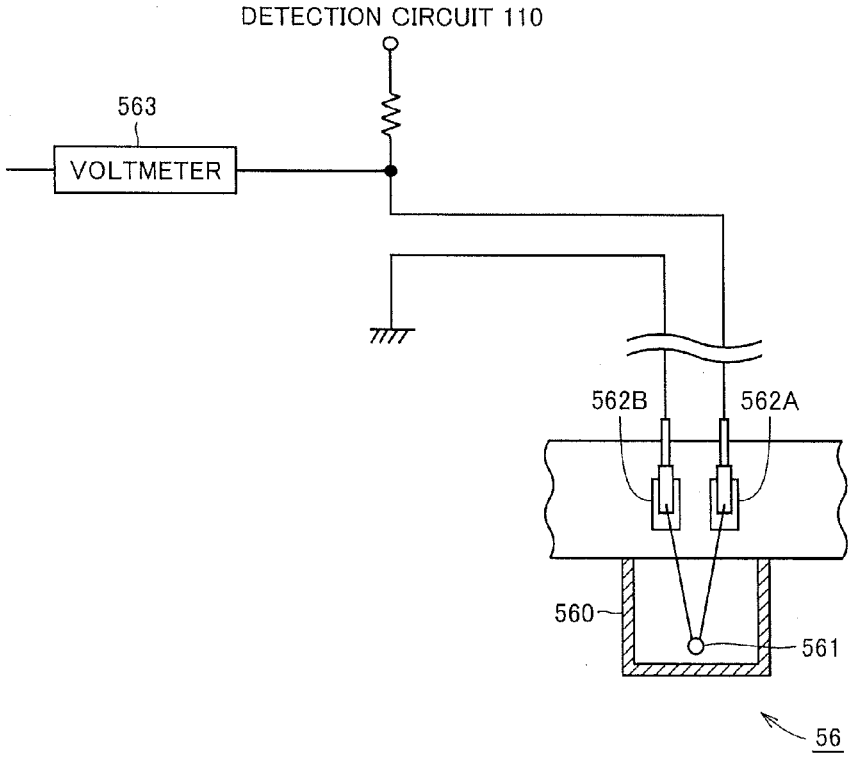
FIG. 5 is a diagram showing a configuration of a thermistor in FIG. 3.

FIG. 5 is a diagram showing a configuration of thermistor 56.

Thermistor 56 includes a resistor element 561. Resistor element 561 is covered with a case 560 from an outer side.

Resistor element 561 is connected to connectors 562A and 562B. Connector 562A is supplied with a voltage for having a voltmeter 563 detect a voltage value. Voltmeter 563 detects a voltage corresponding to a portion consisting of connector 562A, resistor element 561, and connector 562B. A resistance value of resistor element 561 varies depending on a temperature of an atmosphere around thermistor 56. Therefore, in detection circuit 110, a value of a voltage supplied to connector 562A varies depending on a temperature of an atmosphere around thermistor 56. Detection circuit 110 calculates a resistance value of resistor element 561 based on a value of a voltage supplied to connector 562A and calculates a temperature of an atmosphere around thermistor 56 based on the resistance value.

6. Configuration of Thermopile

Figure 6:
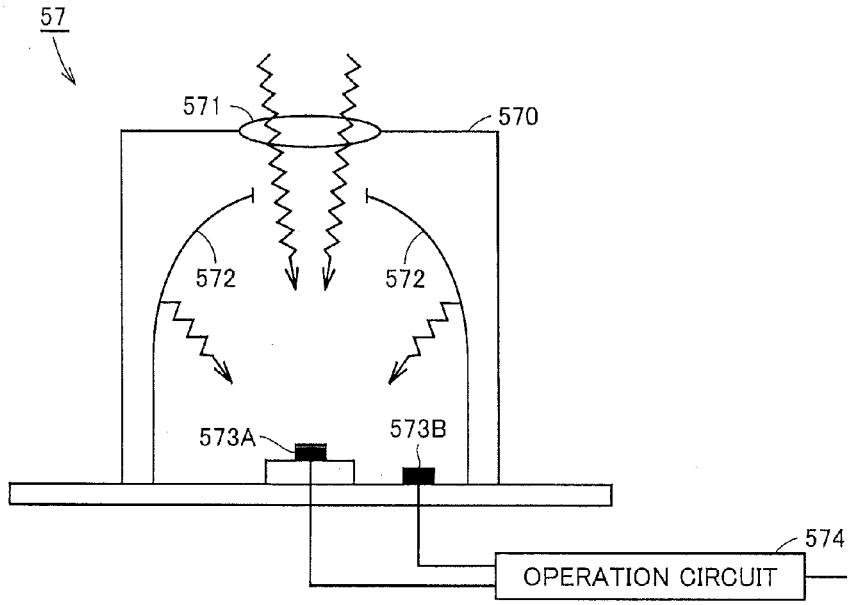
FIG. 6 is a diagram showing a configuration of a thermopile in FIG. 3.

FIG. 6 is a diagram showing a configuration of thermopile 57.

Thermopile 57 is covered with a housing 570 from an outer side. Housing 570 accommodates light reception elements 573A and 573B. In addition, housing 570 is provided with a lens 571 on its surface. Light reception elements 573A and 573B receive infrared rays (wiggly arrows in the figure) entering housing 570 through lens 571 and output a voltage in accordance with a quantity of received rays to an operation circuit 574. Operation circuit 574 determines a temperature detected by thermopile 57 based on an input voltage value. Operation circuit 574 is included in detection circuit 110.

7. Arrangement of Thermistor and Thermopile

Figure 7:
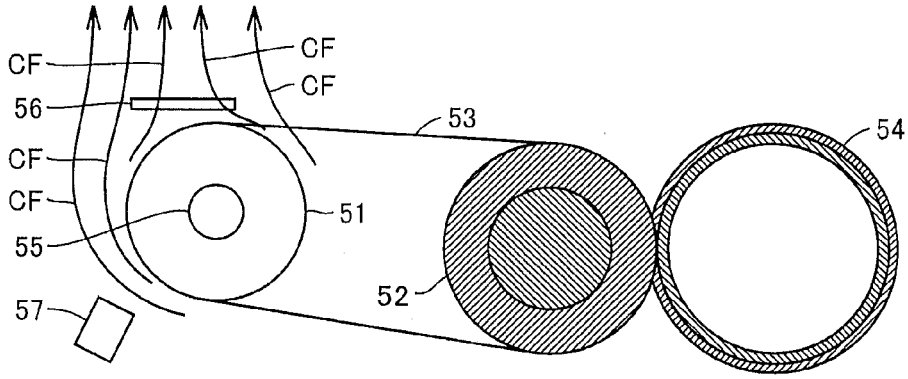
FIG. 7 is a diagram for illustrating characteristic arrangement of the thermistor and the thermopile in the printer in FIG. 1.

In printer 100, thermistor 56 is provided above heating roller 51, and thermopile 57 is provided below heating roller 51. Such arrangement is determined, for example, based on an air current in the vicinity of heating roller 51. FIG. 7 schematically shows an air current CF expected in the vicinity of heating roller 51.

Heating roller 51 is heated to approximately 180° C. for fixing a toner image on recording sheet 14. Therefore, it is considered that an ascending air current is generated in the vicinity of heating roller 51 as shown in FIG. 7.

Then, in printer 100, thermistor 56 for detecting a temperature of an atmosphere is arranged above heating roller 51 where an ascending air current from heating roller 51 flows. Thus, a temperature of heating roller 51 can accurately be detected.

In addition, in printer 100, thermopile 57 is arranged below heating roller 51. Thus, such a situation that toner attached to fixing belt 53 located on the outer side of heating roller 51 is attached to lens 571 by the air current to thereby lower accuracy in temperature detection by thermopile 57 can be avoided.

Meanwhile, if droplets are attached to lens 571 by condensation in thermopile 57, scattering of light or the like is caused by the droplets. Then, light reception elements 573A and 573B cannot receive infrared rays in a quantity in accordance with a temperature of an atmosphere in the vicinity of heating roller 51. Then, a location in printer 100 where thermopile 57 is arranged is set to a location where condensation due to the air current described above is less likely. Thus, condensation on lens 571 can be avoided as much as possible.

8. Operation of Fixing Apparatus (1) General Operation

In printer 100, as power of printer 100 is turned on, an operation to set a surface of fixing belt 53 and pressurization roller 54 to a temperature allowing printing is started. The operation is herein referred to as warm-up and a time period required for that operation is referred to as a warm-up time. In such cases that power of printer 100 is turned on again, printer 100 recovers from a jam fixing process, a cover is closed, printer 100 recovers from a sleep mode, and the like, the warm-up operation is performed.

In the warm-up operation, in order to increase a temperature to the temperature allowing printing, heater 55 is turned on. Then, drive force is transmitted to a not-shown drive gear so that pressurization roller 54 rotates and accordingly fixing belt 53, pressurization roller 52 and heating roller 51 are driven thereby. Thus, heat from heating roller 51 and pressurization roller 54 is transmitted to the surface of fixing belt 53 and pressurization roller 54. A linear velocity of fixing belt 53 in fixing apparatus 30 here is set, for example, to 90 mm/s.

As heaters 55 and 54A are turned on and pressurization roller 54 rotates, a temperature of the surface of fixing belt 53 and pressurization roller 54 is increased to the temperature allowing printing. When both of a corrected thermistor temperature, which is a temperature obtained by correcting a temperature detected by thermistor 56, and a corrected thermopile temperature, which is a temperature obtained by correcting a temperature detected by thermopile 57, attain to a prescribed temperature allowing printing, ready indicating that printing can be carried out is set. For example, when both of the corrected thermistor temperature and the corrected thermopile temperature attained to 185° C., ready is set. It is noted that ready may be set on condition that any one of the corrected thermistor temperature and the corrected thermopile temperature attained to the temperature above.

Printer 100 is in a print stand-by state unless a print signal is generated, and it starts a print operation when a print signal is issued. The print signal is a signal generated based on an operation or the like on operation panel 511, and it is a signal indicating image formation on recording sheet 14. In the stand-by state, normally, rotation of pressurization roller 54 is stopped and drive of heaters 55 and 54A is controlled such that any or both of the corrected thermistor temperature and the corrected thermopile temperature attain(s) to a certain setting temperature. The setting temperature is set, for example, to 185° C.

When a print signal is generated, pressurization roller 54 starts to rotate. Namely, when image formation on recording sheet 14 is started in printer 100, pressurization roller 54 rotates from the time point of start of image formation to entry of recording sheet 14 in fixing apparatus 30, so that heat from heating roller 51 and pressurization roller 54 conducts to the surface of fixing belt 53 and pressurization roller 54 to increase a temperature of the nipping portion.

In an example where plain paper is adopted as recording sheet 14, in image formation, a linear velocity of fixing belt 53 is set, for example, to 90 mm/s. The setting temperature is set, for example, to 185° C. Regarding temperature control, ON/OFF of heaters 55 and 54A is controlled based on any or both of the corrected thermistor temperature and the corrected thermopile temperature.

(2) Correction of Temperature Detected by Thermopile

A temperature obtained by performing processing by using a correction value for a temperature detected by thermopile 57 is defined as a corrected thermopile temperature. The correction value is set in advance in a new-product state where there is no condensation or contamination. The correction value set in advance may be held as an ASIC (Application Specific Integrated Circuit) in thermopile 57. Alternatively, the correction value may be a difference or a ratio between temperatures detected by thermopile 57 and thermistor 56 when power of printer 100 is first turned on.

Namely, a ratio calculated, for example, as shown in the following equation (1) can be adopted as the correction value.

$$\text{Correction value} = \text{Temperature detected by thermistor} / \text{Temperature detected by thermopile} \quad (1)$$

The obtained correction value is stored in thermopile correction value storage portion 134.

(3) Correction of Temperature Detected by Thermistor

A correction value for a temperature detected by thermistor 56 is calculated for each of a plurality of operation states in fixing apparatus 30. Specifically, the states include a state in which heating roller 51 or the like is caused to rotate without a sheet of paper passing the nipping portion such as a warm-up operation (hereinafter "during rotation"), a state in which rotation of heating roller 51 or the like has been stopped (hereinafter "stand-by"), and a state in which an image is formed, that is, recording sheet 14 is inserted in the nipping portion (hereinafter "paper passage").

In printer 100, during the warm-up operation, a correction value for a temperature detected by thermistor 56 is calculated by using a temperature detected by thermistor 56 and a temperature detected by thermopile 57 in each of these states.

Specifically, a temperature detected by thermistor 56 and a temperature detected by thermopile 57 during rotation are obtained, and a correction value is calculated in accordance with the following equation (2) using these detected temperatures. A correction value thus obtained is hereinafter referred to as a "correction value (B)".

$$\text{Correction value } (B) = \text{Corrected thermopile temperature} + \text{Temperature detected by thermistor} \quad (2)$$

Here, the corrected thermopile temperature is a temperature obtained by correcting the temperature detected by thermopile 57 with the correction value described with reference to the equation (1).

Correction value (B) is stored in during-rotation correction value storage portion 135.

In addition, a temperature detected by thermistor 56 and a temperature detected by thermopile 57 during stand-by are obtained, and a correction value is calculated in accordance with the following equation (3) using these detected temperatures. A correction value thus obtained is hereinafter referred to as a "correction value (A)".

$$\text{Correction value } (A) = \text{Corrected thermopile temperature} + \text{Temperature detected by thermistor} \quad (3)$$

Correction value (A) is stored in during-stand-by correction value storage portion 136.

Moreover, a temperature detected by thermistor 56 and a temperature detected by thermopile 57 during paper passage are obtained, and a correction value is calculated in accordance with the following equation (4) using these detected temperatures. A correction value thus obtained is hereinafter referred to as a "correction value (C)".

$$\text{Correction value } (C) = \text{Corrected thermopile temperature} + \text{Temperature detected by thermistor} \quad (4)$$

Correction value (C) is stored in during-paper-passage correction value storage portion 137.

In printer 100, a temperature of heater 55 is controlled based on a temperature detected by thermopile 57 or a corrected thermopile temperature, however, it may be controlled based on a temperature detected by thermistor 56 or a product of a temperature detected by thermistor 56 and any of correction value (A) to correction value (C) (corrected thermistor temperature).

In particular, during stand-by or during reverse rotation of fixing belt 53 (rotation in a direction reverse to arrow R1 in FIG. 3), control based on a temperature detected by thermistor 56 or a corrected thermistor temperature is preferred, because, during stand-by, thermistor 56 can detect a temperature of a portion of fixing belt 53 in contact with heating roller 51 and because, during reverse rotation, thermistor 56 can detect a temperature at a position more downstream of the nipping portion than thermopile 57, and a temperature of the nipping portion can more appropriately be controlled. It is noted that, during reverse rotation, a product of a temperature detected by thermistor 56 and correction value (B) is preferably used for controlling a temperature of heater 55.

Further, when the inside of fixing apparatus 30 is high in humidity (humidity detected by humidity sensor 60 is equal to or higher than a specific value), a temperature of heater 55 is preferably controlled based on a temperature detected by thermistor 56 or a corrected thermistor temperature, instead of a temperature detected by thermopile 57. This is because condensation or the like on lens 571 may lower accuracy in temperature detection by thermopile 57.

In a final stage of a life of duration of fixing apparatus 30, that is, when a time period for which fixing apparatus 30 was used for image formation has exceeded a prescribed time period or when the number of times of image formation has exceeded a prescribed value as well, a temperature of heater 55 is preferably controlled based on a temperature detected by thermistor 56 or a corrected thermistor temperature, instead of a temperature detected by thermopile 57. This is because there is concern about contamination of lens 571 and such contamination may lower accuracy in temperature detection by thermopile 57.

9. Variation Etc.

In the present embodiment described above, fixing apparatus 30 is provided in printer 100 and thermistor 56 and thermopile 57 each for detecting a temperature of heating roller 51 are provided in fixing apparatus 30. Thermistor 56 is provided above heating roller 51 in a manner not in contact with heating roller 51, so as to detect a temperature of an atmosphere. Thermopile 57 is arranged below heating roller 51.

Figure 8:
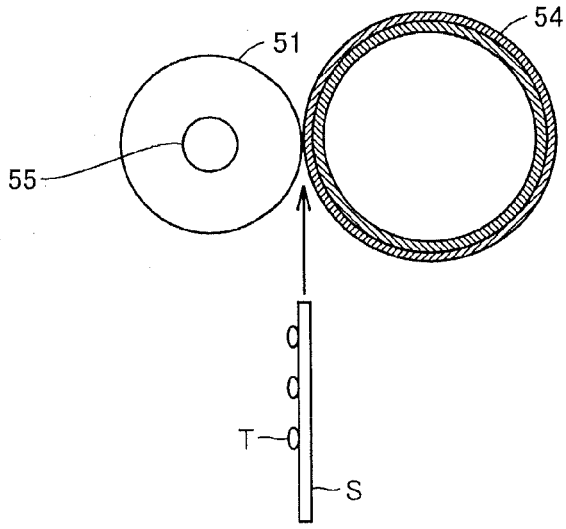
FIG. 8 is a diagram showing a structure of a variation of the fixing apparatus in FIG. 1.

It is noted that various conditions and settings in fixing apparatus 30 are not limited to those mentioned in the present embodiment. Thermistor 56 may be replaced with a thermocouple. In addition, a heat source of heating roller 51 is not limited to a heater and a resistive heat generator or an induction heating device may be employed. Further, as shown in FIG. 8, the nipping portion may be formed with heating roller 51 and pressurization roller 54 without using a fixing belt, so that a toner image is fixed.

Furthermore, an image forming apparatus may be any of a monochrome/color copier, a printer, a facsimile machine, a multifunction machine as combination thereof, and the like.

Though an example of a heating roller in a fixing apparatus in an image forming apparatus has been exemplified, an object of which temperature should be detected is not limited thereto, and the present invention may be applicable to temperature detection of an object in an apparatus other than the image forming apparatus.

According to fixing apparatus 30 in the present embodiment, a correction amount for a temperature detected by thermistor 56 can be set in accordance with a state of fixing apparatus 30. Thus, a detected temperature can be corrected in accordance with variation in distance at which thermistor 56 is installed or variation in responsiveness of a sensor. Thus, accuracy in temperature adjustment of the nipping portion based on a temperature detected by thermistor 56 can be improved as compared with a case where one type of a correction amount is set in advance. A setting temperature for heater 55 in fixing apparatus 30 can thus be lowered and power consumption in fixing apparatus 30 and printer 100 can be reduced.

According to the present embodiment described above, the heating rotating member is heated for fixing toner by heating. Thus, an air current owing to heat convection is produced in the vicinity of the heating rotating member. In addition, two types of detection portions for detecting a temperature of the heating rotating member are provided. The first detection portion for detecting a temperature of an atmosphere attained by heat conduction detects a temperature at a position above the heating rotating member, so that an ascending air current caused by heat convection can reliably be grasped and a temperature of the heating rotating member can more accurately be detected. Moreover, the second detection portion for detecting a quantity of infrared rays radiated from the heating rotating member detects a temperature at a position below the heating rotating member, so that the ascending current caused by heat convection can be avoided and thus contamination by toner or the like attached to the heating rotating member can be avoided as much as possible.

Therefore, such a situation that accuracy in temperature detection is lowered by contamination at the detection surface of the second detection portion can more reliably be avoided.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member; and a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, wherein said control portion corrects said second detected temperature based on said first detected temperature.

2. An image forming apparatus, comprising:

an image forming portion for forming a toner image on a sheet of paper; and the fixing apparatus according to claim 1.

3. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member;

a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, and a storage portion for storing a value for correcting said first detected temperature and indicating relation between said first detected temperature and said second detected temperature, wherein the value stored in said storage portion includes a first value indicating relation in a first state in which said heating rotating member remains stopped, a second value indicating relation in a second state which is a state where said heating rotating member rotates without fixing a toner image on a sheet of paper by heating, and a third value indicating relation in a third state which is a state where said heating rotating member rotates while fixing a toner image on a sheet of paper by heating, and said control portion corrects said first detected temperature with said second detected temperature and said first value in said first state, corrects said first detected temperature with said second detected temperature and said second value in said second state, and corrects said first detected temperature with said second detected temperature and said third value in said third state.

4. An image forming apparatus, comprising:

an image forming portion for forming a toner image on a sheet of paper; and the fixing apparatus according to claim 3.

5. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member;

a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, and a fixing belt wound around said heating rotating member and a first pressurization roller and pressed against a second pressurization roller to form a nipping portion, wherein said control portion can control the number of unit paper passages representing the number of sheets of paper fed to said nipping portion per unit time, said first detection portion and said second detection portion detect a temperature at positions different from each other in a direction of rotation of said heating rotating member, and said control portion increases said number of unit paper passages when a temperature detected upstream of said nipping portion, of said first detected temperature and said second detected temperature, is higher than a temperature detected downstream of said nipping portion, and said control portion decreases said number of unit paper passages when a temperature detected upstream of said nipping portion, of said first detected temperature and said second detected temperature, is lower than a temperature detected downstream of said nipping portion.

6. An image forming apparatus, comprising:

an image forming portion for forming a toner image on a sheet of paper; and the fixing apparatus according to claim 5.

7. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member;

a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, and a fixing belt wound around said heating rotating member and a first pressurization roller and pressed against a second pressurization roller to form a nipping portion, wherein said first detection portion and said second detection portion detect a temperature at positions different from each other in a direction of rotation of said heating rotating member, and said control portion lowers a target heating temperature of said heating rotating member when a temperature detected upstream of said nipping portion, of said first detected temperature and said second detected temperature, is higher than a temperature detected downstream of said nipping portion, and said control portion raises a target heating temperature of said heating rotating member when a temperature detected upstream of said nipping portion, of said first detected temperature and said second detected temperature, is lower than a temperature detected downstream of said nipping portion.

8. An image forming apparatus, comprising:

an image forming portion for forming a toner image on a sheet of paper; and the fixing apparatus according to claim 7.

9. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member;

a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, and a fixing belt wound around said heating rotating member and a first pressurization roller and pressed against a second pressurization roller to form a nipping portion, wherein said first detection portion and said second detection portion detect a temperature at positions different from each other in a direction of rotation of said heating rotating member, a direction of rotation of said heating rotating member can be varied, and said control portion controls heating by said heating portion based on a temperature detected downstream of said nipping portion in the direction of rotation of said heating rotating member at a time point of detection, of said first detected temperature and said second detected temperature.

10. An image forming apparatus, comprising:

an image forming portion for forming a toner image on a sheet of paper; and the fixing apparatus according to claim 9.

11. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member;

a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, and a fixing belt wound around said heating rotating member and a first pressurization roller and pressed against a second pressurization roller to form a nipping portion, wherein said second detection portion detects a temperature at a position more upstream of said nipping portion than said first detection portion, said second detected temperature is corrected with said first detected temperature, and said control portion controls heating by said heating portion based on corrected said second detected temperature.

12. An image forming apparatus, comprising:

an image forming portion for forming a toner image on a sheet of paper; and the fixing apparatus according to claim 11.

13. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member;

a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, a housing for accommodating said heating rotating member; and a humidity detection portion for detecting humidity in said housing, wherein said control portion controls heating by said heating portion based on said first detected temperature when humidity detected by said humidity detection portion is equal to or higher than a prescribed value.

14. An image forming apparatus, comprising:

an image forming portion for forming a toner image on a sheet of paper; and the fixing apparatus according to claim 13.

15. A fixing apparatus, comprising:

a heating rotating member for fixing a toner image on a sheet of paper by heating;

a first detection portion for detecting a temperature of an atmosphere attained by heat conduction from said heating rotating member as a first detected temperature;

a second detection portion for detecting a quantity of infrared rays radiated from said heating rotating member;

a heating portion for heating said heating rotating member;

a control portion for controlling heating by said heating portion based on said first detected temperature from said first detection portion and a second detected temperature corresponding to the quantity of infrared rays from said second detection portion, said first detection portion detecting a temperature at a position above said heating rotating member, and said second detection portion detecting a temperature at a position below said heating rotating member, and a count portion for counting time since start of use of said second detection portion, wherein when the time counted by said count portion exceeds prescribed time, said control portion controls heating by said heating portion based on said first detected temperature.

16. An image forming apparatus, comprising:

an image forming portion for forming a toner image on a sheet of paper; and the fixing apparatus according to claim 15.

* * * * *